US008302728B1

(12) United States Patent
Dotson

(10) Patent No.: US 8,302,728 B1
(45) Date of Patent: Nov. 6, 2012

(54) FOUR-WHEEL STEERING SYSTEM FOR RADIO-CONTROLLED CARS

(76) Inventor: Jerry T. Dotson, Sarasota, FL (US)

( * ) Notice: Subject to any disclaimer, the term of this patent is extended or adjusted under 35 U.S.C. 154(b) by 771 days.

(21) Appl. No.: 12/489,229

(22) Filed: Jun. 22, 2009

(51) Int. Cl.
*B62D 7/16* (2006.01)

(52) U.S. Cl. ..... 180/408; 280/99

(58) Field of Classification Search ..... 180/234, 180/433, 434, 435, 444; 280/81.5, 81.6, 280/93.502, 93.503, 93.506, 98, 99, 419; 74/484 R, 486, 496; 446/468
See application file for complete search history.

(56) References Cited

U.S. PATENT DOCUMENTS

| | | | | | |
|---|---|---|---|---|---|
| 2,132,828 | A | * | 10/1938 | Montambo | 280/98 |
| 2,812,191 | A | * | 11/1957 | Kersey, Jr. et al. | 180/409 |
| 3,075,784 | A | * | 1/1963 | Beyerstedt | 180/414 |
| 3,305,041 | A | | 2/1967 | Schramm | |
| 3,446,307 | A | * | 5/1969 | Logus | 180/414 |
| 3,596,730 | A | * | 8/1971 | Cecce | 180/236 |
| 4,105,086 | A | | 8/1978 | Ishii et al. | |
| 4,162,859 | A | * | 7/1979 | McAfee | 403/75 |
| 4,586,722 | A | * | 5/1986 | Watanabe et al. | 280/103 |
| 4,589,510 | A | | 5/1986 | Diierwald | |
| 4,798,393 | A | * | 1/1989 | Miura et al. | 180/409 |
| 4,878,556 | A | * | 11/1989 | Wells | 180/414 |
| 4,999,003 | A | * | 3/1991 | Koishi et al. | 280/103 |
| 5,048,852 | A | | 9/1991 | Chikuma et al. | |
| 5,174,595 | A | * | 12/1992 | Snipes | 180/411 |
| 5,503,586 | A | | 4/1996 | Suto | |
| 5,527,059 | A | | 6/1996 | Lee, Jr. | |
| 5,882,241 | A | | 3/1999 | Mullaney et al. | |
| 6,170,354 | B1 | * | 1/2001 | Lee | 74/496 |
| 6,308,976 | B1 | * | 10/2001 | Mitchell | 280/419 |
| 7,024,843 | B2 | * | 4/2006 | Hunt et al. | 56/6 |
| 7,347,434 | B2 | | 3/2008 | Lewis et al. | |
| 7,922,184 | B2 | * | 4/2011 | Porcheron | 280/93.506 |
| 2006/0096800 | A1 | * | 5/2006 | Saibold et al. | 180/434 |
| 2006/0289218 | A1 | | 12/2006 | Allen | |

FOREIGN PATENT DOCUMENTS

| | | |
|---|---|---|
| GB | 2278064 A | 11/1994 |

* cited by examiner

*Primary Examiner* — Lesley D Morris
*Assistant Examiner* — Daniel Yeagley
(74) *Attorney, Agent, or Firm* — Charles J. Prescott

(57) ABSTRACT

A four-wheel steering system for a remote control vehicle. The system includes a pair of steering actuators driving a pair of front bell cranks. A front toe link is pivotally connected to each of the spaced front bell cranks for lateral translation. Right and left front tie rods are each pivotally connected between corresponding ends of the front toe link and a corresponding front steering knuckle. An elongated center tie rod is pivotally connected between one front bell crank and one of a pair of rear bell cranks. An elongated rear toe link is dependently pivotally connected to the pair of rear bell cranks for lateral translation. Right and left rear tie rods are each pivotally connected between corresponding ends of the rear toe link and corresponding right and left rear steering knuckles whereby the front knuckles steer in one direction while the rear knuckles steer in an opposite direction.

3 Claims, 5 Drawing Sheets

FOUR-WHEEL STEERING SYSTEM FOR RADIO-CONTROLLED CARS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to radio-controlled miniature vehicles, and more particularly to a radio-controlled vehicle having four-wheel steering capabilities.

2. Description of Related Art

Radio-controlled land vehicles have become quite developed and sophisticated and, in many cases, mirror the functional and structural capabilities of their full-sized drivable counterparts. One aspect of full-sized off road and land buggy type vehicles which has been imported into the radio controlled models is that of four-wheel drive characteristics. These off road and land buggy type vehicles utilize extreme four-wheel drive characteristics to achieve very unique steering performance characteristics.

A number of prior art systems and devices are known to afford various four-wheel steering characteristics. Mullaney et al. teaches a radio controlled toy vehicle with movable front end in U.S. Pat. No. 5,882,241. U.S. Patent Application Publication US 2006/0289218 to Allen discloses a vehicle capable of turning 360° and a four-wheel steering assembly is disclosed in U.S. Pat. No. 7,347,434 to Lewis, et al. United Kingdom Patent 2,278,064 to Kang teaches a radio-controlled car with rotatable driver having two independent motor-gear boxes to turn front and wheels in the same or opposite directions.

U.S. Pat. No. 3,305,041 to Schramm discloses a four-wheel steering system for tractors having front and rear steerable pairs of wheels. Ishii et al. teaches a steering control system for vehicular four-wheel steering mechanisms in U.S. Pat. No. 4,105,086. A multiple wheel steering mechanism is disclosed in U.S. Pat. No. 4,589,510 to Diierwald et al.

Chikuma et al. teaches a four wheel steering apparatus in U.S. Pat. No. 5,048,852 which permits increase of the steering angle of the rear wheels to be effected only in a relation to the steering angle of the front wheels and which also permits a reduction of the steering angle of the rear wheels independently of the steering of the front wheels U.S. Pat. No. 5,503,586 to Suto discloses a gear system for use as a steering system in a toy vehicle for controlling the vehicle's wheels so as to have the vehicle move ahead or turn on the spot. A remotely operated model vehicle height adjustment device is disclosed in U.S. Pat. No. 5,527,059 to Lee, Jr.

Piston or gas engine powered R/C land vehicles are known to achieve very high speeds in the range of 40 to 60 mph. Utilized conventional two-wheel or four-wheel steering technology for such vehicles taxes the capabilities of current R/C servo or actuator and linkage technology with respect to both strength and stability.

The present invention provides an improved four-wheel steering system for R/C vehicles of the high performance and high speed capability category which enhances both strength and performance capability of the four-wheel drive steering system by providing two separate servo or actuator mechanisms simultaneously delivering power to the steering system in parallel to provide extreme performance and stability in a four-wheel drive steering system.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a four-wheel steering system for a remote control (R/C) vehicle. The system includes a pair of steering actuators operating in parallel to drive a pair of front bell cranks. An elongated front toe link is dependently pivotally connected to each of the spaced front bell cranks for lateral translation of the front toe link driven by the actuators. Right and left front tie rods are each pivotally connected between corresponding ends of the front toe link and corresponding right and left front steering knuckles. An elongated center tie rod is pivotally connected between one front bell crank and one of a pair of rear bell cranks. An elongated rear toe link is dependently pivotally connected the pair of rear bell cranks for lateral translation. Right and left rear tie rods are each pivotally connected between corresponding ends of the rear toe link and corresponding right and left rear steering knuckles whereby when the front knuckles turn in one direction, the rear knuckles turn in a direction opposite to that of the front steering knuckles.

It is therefore an object of this invention to provide a four-wheel steering system for remote-controlled (R/C) toy land vehicles which affords high four-wheel steering capabilities and multiple servo controlled input to the steering system for enhanced power and central for high-speed vehicles.

Still another object of this invention is to provide a dual servo four-wheel drive steering system which achieves dramatic steering characteristics for high performance R/C land vehicles.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
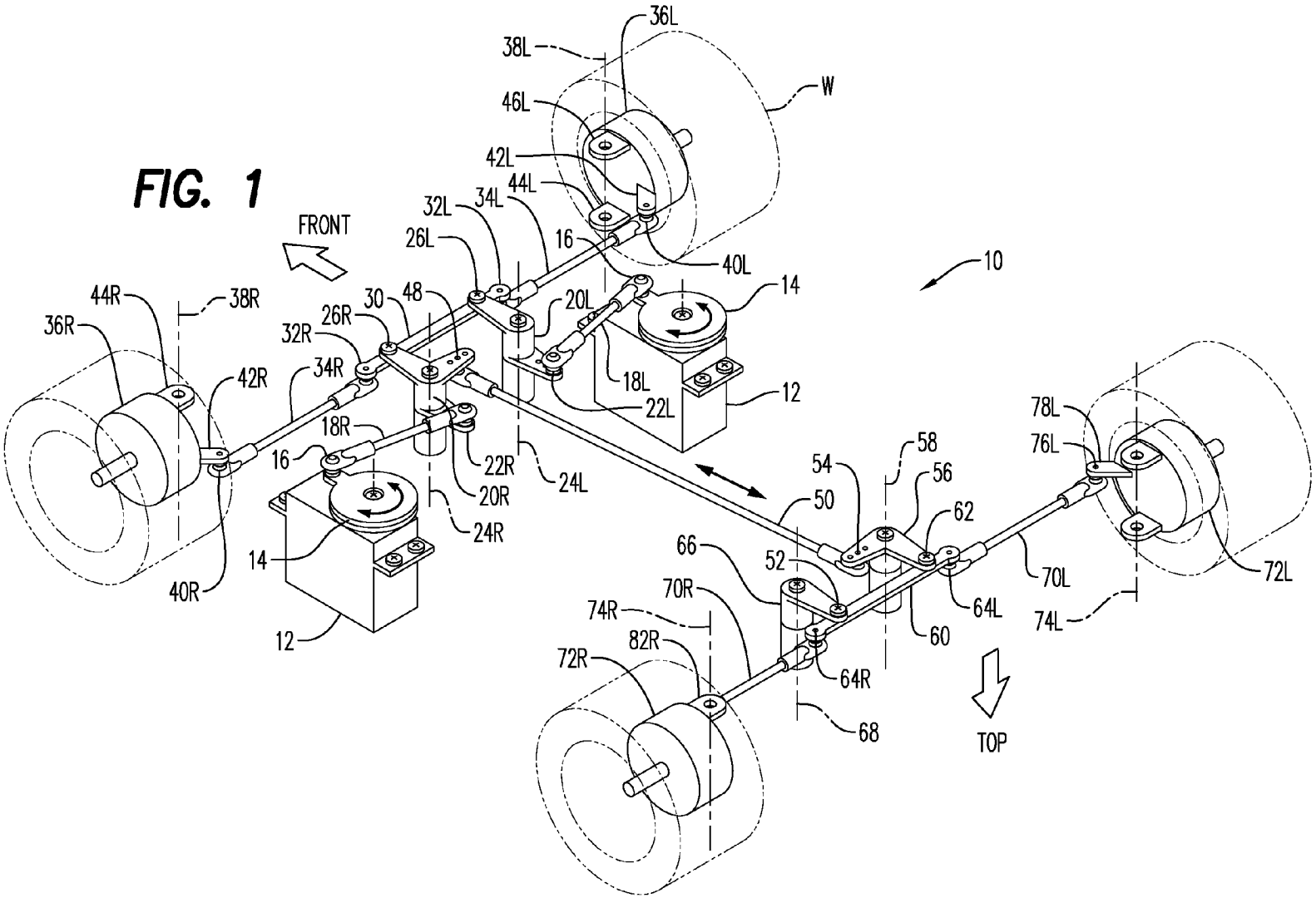
FIG. 1 is a perspective view of a four-wheel drive steering system provided by this disclosure shown from the underside or bottom side direction.
Figure 2:
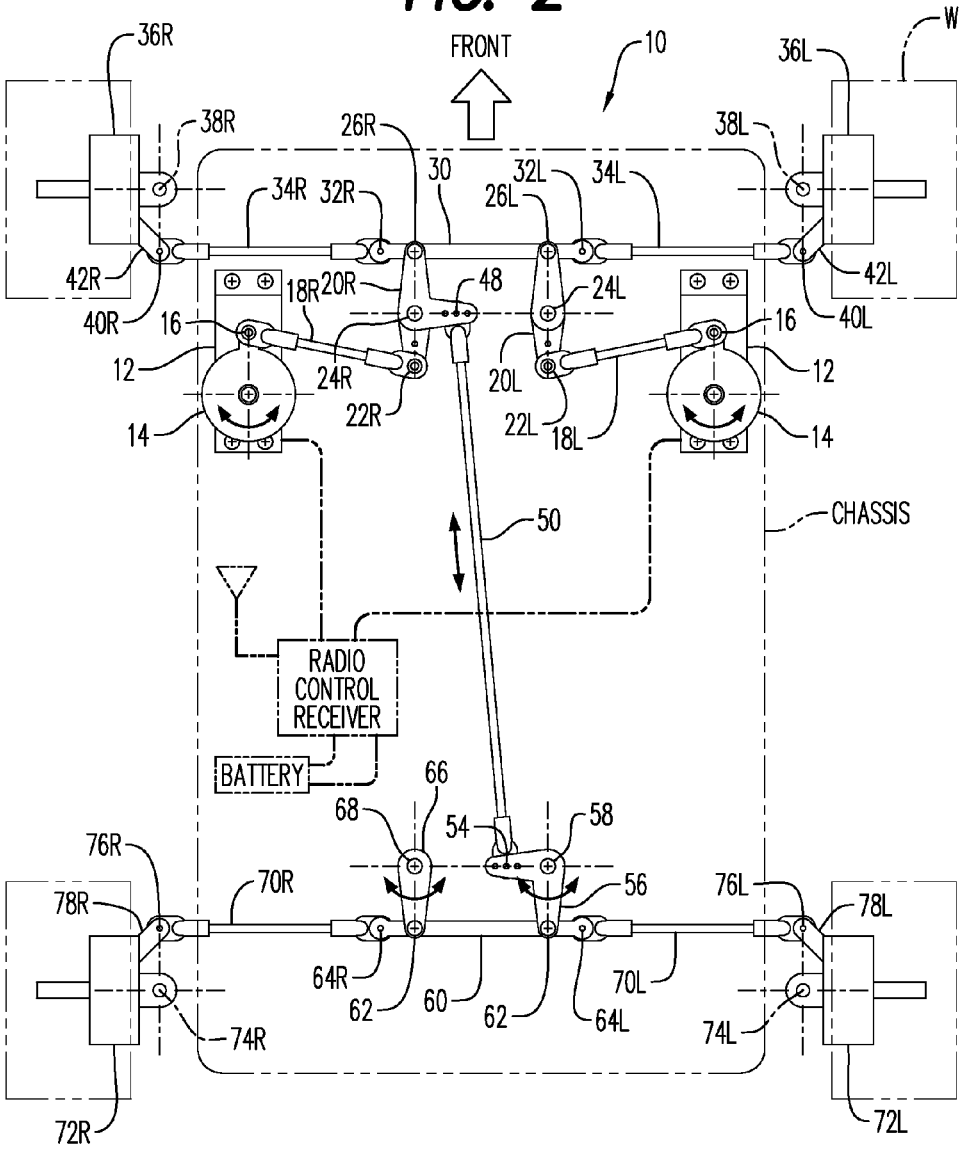
FIG. 2 is a bottom plan view of FIG. 1 showing a chassis and R/C components in phantom.

Exemplary embodiments are illustrated in reference figures of the drawings. It is intended that the embodiments and figures disclosed herein are to be considered to be illustrative rather than limiting.

| List of Components | |
|---|---|
| 10. | steering system |
| 12R. | right servo |
| 12L. | left servo |
| 14R. | right servo arm |
| 14L. | left servo arm |
| 16R. | ball link |
| 16L. | ball link |
| 18R. | right servo tie rod |
| 18L. | left servo tie rod |
| 20R. | three-arm front bell crank |
| 20L. | straight two-arm front bell crank |
| 22R. | ball link |
| 22L. | ball link |
| 24R. | pivot axis |
| 24L. | pivot axis |
| 26R. | front pivot pin |
| 26L. | front pivot pin |
| 28. | |
| 30. | front toe link |
| 32R. | toe link pivot pin |
| 32L. | toe link pivot pin |
| 34R. | right front tie rod |
| 34L. | left front tie rod |
| 36R. | right front steering knuckle |
| 36L. | left front steering knuckle |
| 38R. | right front steering axis |
| 38L. | left front steering axis |
| 40R. | right front tie rod end |
| 40L. | left front tie rod end |
| 42R. | right front steering arm |
| 42L. | left front steering arm |
| 44R. | right front lower knuckle bearing |
| 44L. | left front lower knuckle bearing |
| 46R. | right front upper knuckle bearing |
| 46L. | left front upper knuckle bearing |
| 48. | front center tie rod ball link |
| 50. | center tie rod |
| 52. | right rear pivot pin |
| 54. | rear center tie rod ball link |
| 56. | 90° two-arm rear ball crank |
| 58. | left rear pivot axis |
| 60. | rear toe link |
| 62. | left rear pivot pin |
| 64R. | rear toe link pivot pin |
| 64L. | rear toe link pivot pin |
| 66. | one-arm rear bell crank |
| 68. | right rear pivot axis |
| 70R. | right rear tie rod |
| 70L. | left rear tie rod |
| 72R. | right rear steering knuckle |
| 72L. | left rear steering knuckle |
| 74R. | right rear steering axis |
| 74L. | left rear steering axis |
| 76R. | right rear tie rod end |
| 76L. | left rear tie rod end |
| 78R. | right rear steering arm |
| 78L. | left rear steering arm |

DETAILED DESCRIPTION OF THE INVENTION

Referring now to the drawings, the four-wheel drive steering system of this disclosure is generally shown at numeral 10 in conjunction with a vehicle chassis and radio controlled components including a receiver and a battery (shown in phantom in FIG. 2) for powering and controlling the actuators 12 of the system 10. Note that all of the views in FIGS. 1 to 4 are from the under or bottom side of the vehicle and chassis for clarity.

Figure 5:
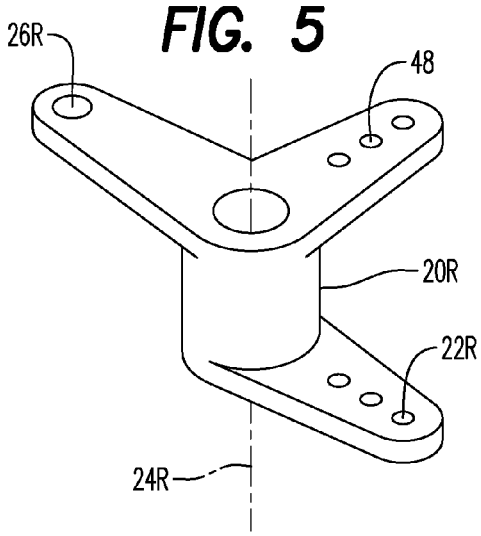
FIGS. 5 to 8 are perspective views of the various bell cranks shown in the previous figures.
Figure 6:
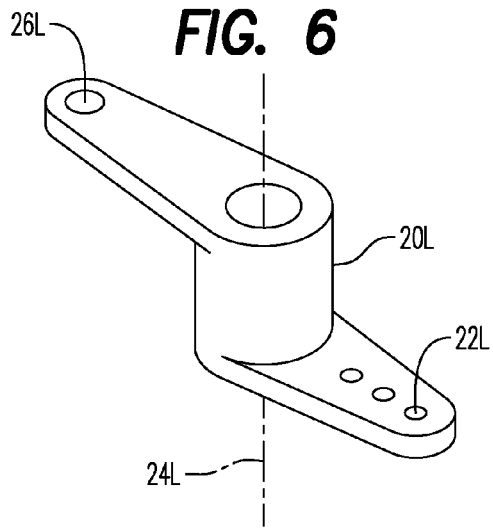
Figure 7:
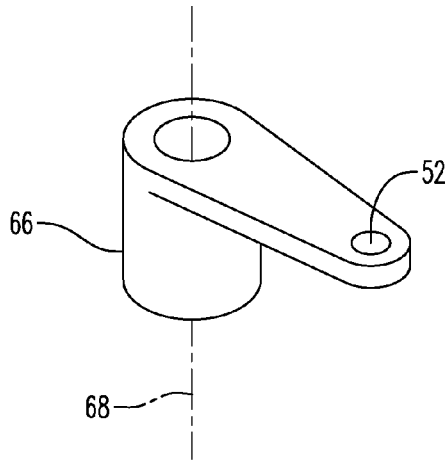

The system 10 includes a pair of steering actuators or servos shown at 12 preferably mounted to the chassis adjacent the front of the vehicle. Each of these actuators 12 includes a two directional rotational output wheel 14 having a travel of approximately ±45°, the exact angular orientations of which are controlled by the R/C components. A pair of front bell cranks 20R and 20L, mounted to the chassis about upright axes 24R and 24L, are each connected to one of the actuators 12 by right and left servo tie rod 18R and 18L, respectively. These front bell cranks 20R and 20L are shown in FIGS. 5 and 6.

Figure 3:
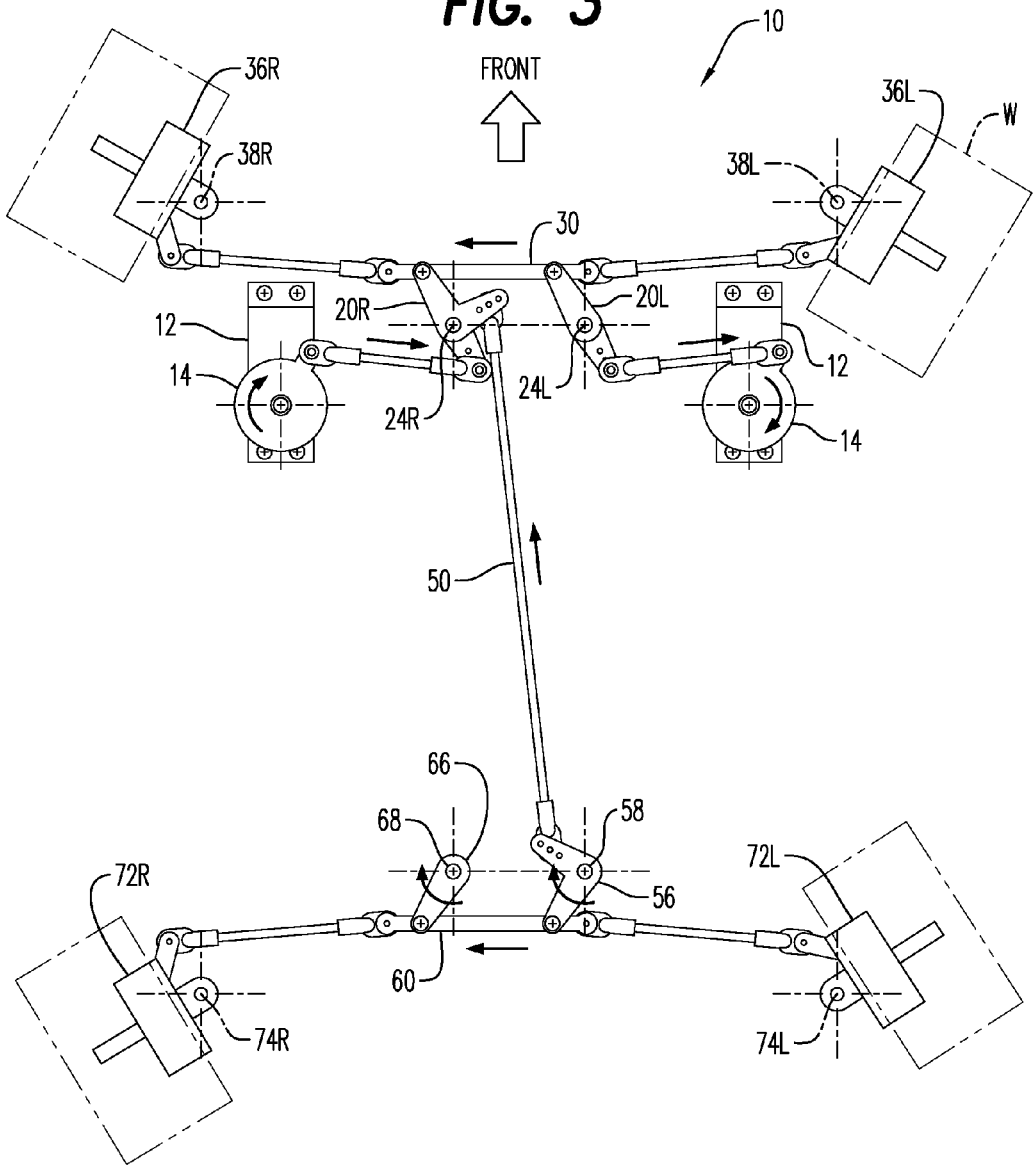
FIG. 3 is a view of FIG. 2 showing the steering system in a maximum left hand turn orientation.
Figure 4:
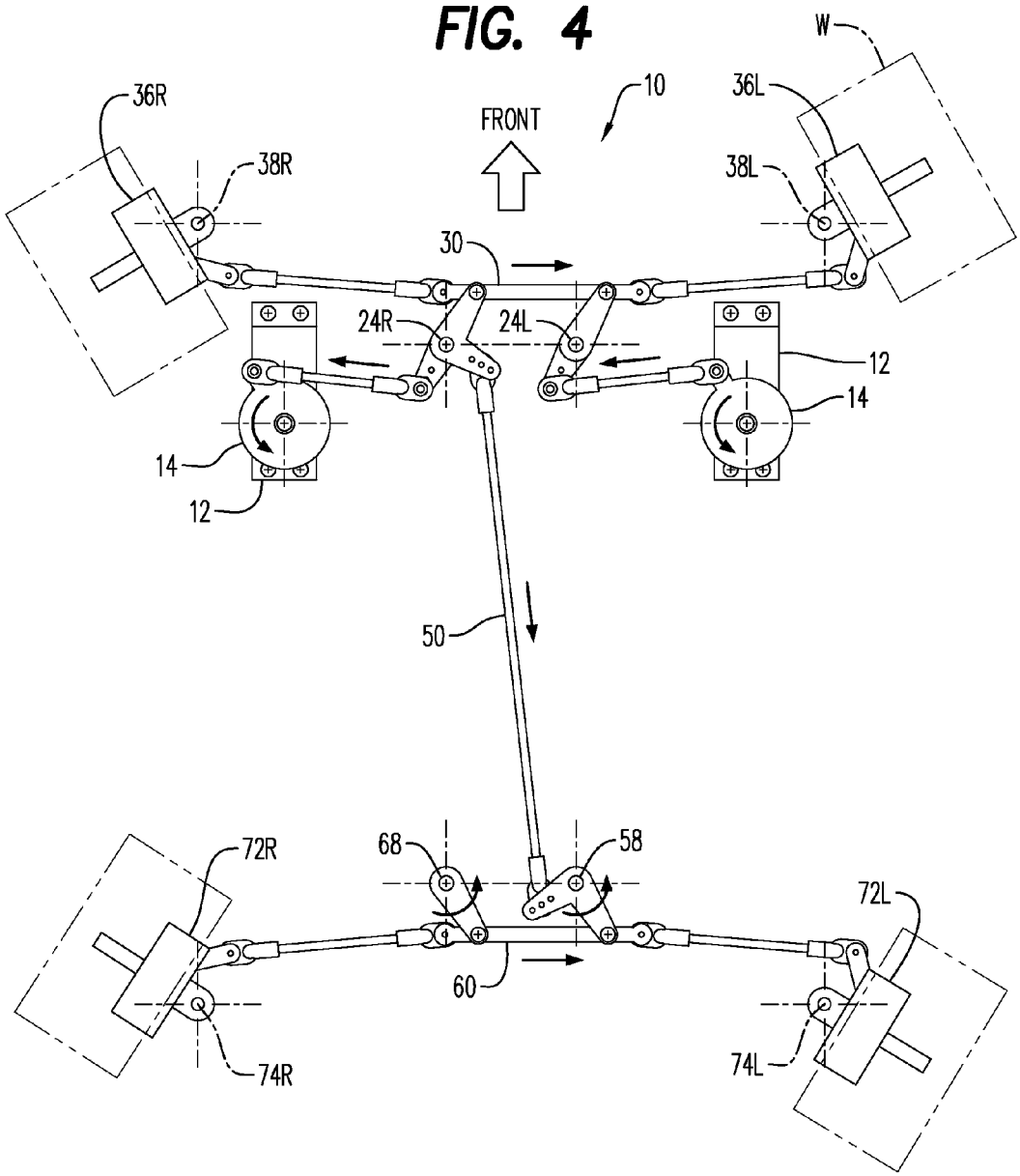
FIG. 4 is a view similar to FIG. 3 showing the steering system in a maximum right hand turn steering orientation.

The right front bell crank 20R is of a unique three-armed configuration mounted for rotation about the vertical axis 24R to the chassis. The right servo tie rod 18R is pivotally connected to one of the mounting holes 22R of one of the arms of front bell crank 20R while the forwardly facing arm is pivotally connected through mounting hole 26R to an elongated front toe link 30. The left front bell crank 20L is of a 180° configuration, the rearward-facing arm pivotally connected at mounting hole 22L to the inner end of the left servo tie rod 18L. The forwardly facing arm of bell crank 20L is also pivotally connected at mounting hole 26L to the front toe link 30 in symmetric spaced relationship with respect to the pivotal connection 26R of the forwardly facing arm of bell crank 20R. By this arrangement, as the output wheels 14 of the servos 12 are rotated clockwise as shown in FIG. 3 or counterclockwise as shown in FIG. 4, the front toe link 30 moves in a corresponding direction of the arrows laterally with respect to the length of the chassis without undesirable rotational movement.

Right and left front tie rods 34R and 34L are each pivotally connected at an inner end thereof to a corresponding end of the front toe link 30 at 32R and 32L, respectively. The outer ends of each of the front tie rods 34R and 34L are pivotally connected at 40R and 40L to a corresponding steering arm 42R and 42L of a right front and left front steering knuckle 36R and 36L, respectively. These steering knuckles 36R and 36L, as best seen in FIGS. 3 and 4, are pivotally rotated about a corresponding upright front steering axis 38R and 38L wherein, as seen in FIGS. 3 and 4, when the servos 12 are actuated to have a rotational output in a clockwise direction, the front steering knuckles with wheels W (shown in phantom) will steer the vehicle to the left. When the servo outputs are rotated counterclockwise as seen in FIG. 4, the steering knuckles 36R and 36L steer the wheels W to the right.

Figure 8:
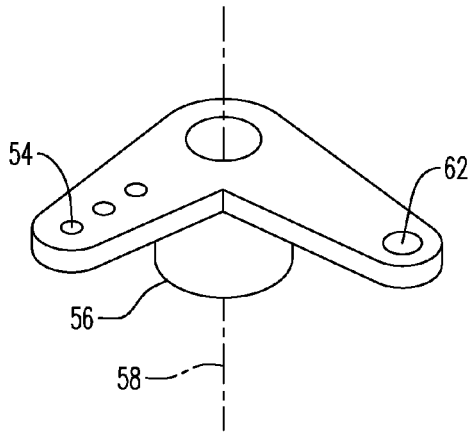

An elongated center tie rod 50 is pivotally connected at a forwardly end thereof to one of the mounting holes 48 in the transversely oriented arm of front bell crank 20R. The rearwardly end of this center tie rod 50 is pivotally connected to one of the mounting holes 54 in a two-arm rear bell crank 56 shown in FIG. 8. This bell crank 56 is also mounted to the chassis about an upright rotational axis 58. A mounting hole 62 in the rearwardly oriented arm of rear bell crank 56 is pivotally connected at 62 to an elongated rear toe link 60. A single arm bell crank 66 pivotally connected about an upright rotational axis 68 to the chassis in spaced relationship to rear bell crank 56 is pivotally connected through hole 62 to the rear toe link 60 in symmetric spaced relationship along the length of the rear toe link 60 to the left rear pivot pin 62. Again, by this relationship, as the center tie rod 50 is moved generally fore and aft shown by the arrows responsive to corresponding rotational output of the servos 12, the rear bell cranks 56 and 66 rotate in the corresponding rotational direction of the arrows to cause the rear toe link 60 to move laterally without substantial rotation in the direction of the corresponding arrows in FIGS. 3 and 4.

Elongated right and left rear tie rods 70R and 70L are pivotally connected at their inner ends at 64R and 64L, respectively, to the ends of the rear toe link 60. The outer ends of each of the rear tie rods 70R and 70L are pivotally connected at 76R and 76L, respectively, to steering arms 78R and 78L of right and left rear steering knuckles 72R and 72L. These rear steering knuckles 72R and 72L are themselves pivotally mounted about upright steering axes 74R and 74L by suspension arms (not shown) which are operably connected to the chassis.

The dramatic steering capabilities of this four-wheel steering system 10 are clearly exhibited by comparing FIGS. 3 and 4 to achieve extreme vehicle steering mobility aided by the extra power delivery of two R/C servos 12 acting in parallel action to multiply the power delivery and stability to this four-wheel steering system for R/C vehicles. Moreover, the articulation of the front and rear steering knuckles is made substantially more accurate and realistic due to the unique motion of the front and rear toe links 30 and 60 which move laterally absent any twist or rotation which would otherwise degrade the accuracy of the steering knuckle articulation responsive to input control to the onboard R/C receiver component.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A system for controlling a four-wheel steering mechanism for a remote control vehicle having a pair of front steering knuckles and a pair of rear steering knuckles operably connected to a vehicle chassis, comprising:

a pair of steering actuators each having two-direction rotational output selectively regulated by radio-controlled components;

a pair of front bell cranks each operably connected to one said actuator for simultaneous driven rotational movement by said actuators;

an elongated front toe link dependently pivotally connected to each of said front bell cranks for lateral translation of said front toe link responsive to rotational output of said actuators;

right and left elongated front tie rods each pivotally connected at an inner end thereof to a corresponding end of said front toe link, an outer end of each said front tie rod pivotally connected to a corresponding one of said front steering knuckles;

an elongated center tie rod pivotally connected at a forward end thereof to one of said front bell cranks;

a pair of rear bell cranks, one rear bell crank of said pair of rear bell cranks pivotally connected to a rearward end of said center tie rod;

an elongated rear toe link dependently pivotally connected to each of said rear bell cranks for lateral translation of said rear toe link responsive to fore and aft translation of said center tie rod;

right and left rear tie rods each pivotally connected at an inner end thereof to a corresponding end of said rear toe link, an outer end of each said rear tie rod pivotally connected to a corresponding one of the rear steering knuckles;

whereby, when the front knuckles are rotated in a first steering direction by a rotational output of said actuators, the rear knuckles rotate in a second steering direction opposite to that of the front steering knuckles.

2. A system for controlling a four-wheel steering mechanism for a remote control vehicle having a pair of front steering knuckles and a pair of rear steering knuckles operably connected for steering movement to a vehicle chassis, comprising:

a pair of steering actuators each having two-direction rotational output selectively regulated by radio-controlled components;

a pair of front bell cranks each operably connected to one said actuator for simultaneous driven rotational movement by said actuators;

an elongated front toe link dependently pivotally connected to each of said front bell cranks for lateral translation of said front toe link responsive to rotational output of said actuators;

right and left elongated front tie rods each pivotally connected at an inner end thereof to a corresponding end of said front toe link, an outer end of each said front tie rod pivotally connected to a steering arm of a corresponding one of said front steering knuckles;

an elongated center tie rod pivotally connected at a forward end thereof to one of said front bell cranks responsive to said one front bell crank;

a pair of rear bell cranks, one rear bell crank of said pair of rear bell cranks pivotally connected to a rearward end of said center tie rod;

an elongated rear toe link dependently pivotally connected to each of said rear bell cranks for lateral translation of said rear toe link responsive to fore and aft translation of said center tie rod;

right and left rear tie rods each pivotally connected at an inner end thereof to a corresponding end of said rear toe link, an outer end of each said rear tie rod pivotally connected to a steering arm of a corresponding one of the rear steering knuckles;

whereby, when the front knuckles are rotated in a first steering direction by a rotational output of said actuators, the rear knuckles simultaneously rotate in a second steering direction opposite to that of the front steering knuckles.

3. A system for controlling a four-wheel steering mechanism for a remote control vehicle having a pair of front steering knuckles and a pair of rear steering knuckles operably connected to a vehicle chassis, comprising:

a pair of steering actuators each having two-direction rotational output selectively regulated by radio-controlled components;

a pair of front bell cranks each operably connected between one said actuator and an elongated front toe link for lateral translation of said front toe link responsive to rotational output of said actuators;

right and left elongated front tie rods each pivotally connected between a corresponding end of said front toe link and a corresponding one of said front steering knuckles;

an elongated center tie rod pivotally connected between one of said front bell cranks and one of a pair of rear bell cranks;

an elongated rear toe link dependently pivotally connected to each of said rear bell cranks for lateral translation of said rear toe link responsive to fore and aft translation of said center tie rod;

right and left rear tie rods each pivotally connected between a corresponding end of said rear toe link and a corresponding one of the rear steering knuckles;

whereby the front knuckles are rotated in a first steering direction while the rear knuckles rotate in a second steering direction opposite to that of the front steering knuckles.

* * * * *